US005114352A

United States Patent [19]

Gahagen et al.

[11] Patent Number: 5,114,352

[45] Date of Patent: May 19, 1992

[54] ROTATABLE MARINE ELECTRIC CONNECTOR

[76] Inventors: Hugh Gahagen, P.O. Box 492, Lake Como, Fla. 32157; Helen E. Roman, 2755 NE. 28th Ave., Apt. 4-A, Lighthouse Point, Fla. 33064; Sonia Holt, R.R. 1, Box 54, S. Woodstock, Vt. 05071

[21] Appl. No.: 703,740

[22] Filed: May 21, 1991

[51] Int. Cl.[5] ..... H01R 39/02

[52] U.S. Cl. ..... 439/22

[58] Field of Search ..... 439/13, 17-24, 439/27

[56] References Cited

U.S. PATENT DOCUMENTS 2,474,070 6/1949 Sokolik ..... 439/20 X 2,645,759 7/1953 Solari ..... 439/22

*Primary Examiner*—Eugene F. Desmond

[57] ABSTRACT

This invention is a rotatable marine electric connector intended to be used in the transmission of electricity from a dock mounted power receptacle to a vessel moored to said dock. The connector comprises an upper rotatable section to which an electric cable is connected. This upper rotatable section features a rubber boot which helps seal the inside of the connector from the elements. The upper rotatable section is operably and electrically connected to a lower rotatable section. This lower rotatable section connected electrically with an appropriate connecter to complete the circuit an allow power to be supplied the vessel. The upper rotatable section may be allowed to rotate freely with respect to the lower rotatable section, or alternately, a screw may be tightened thereby immobilizing the upper rotatable section with respect to the lower rotatable section.

1 Claim, 1 Drawing Sheet

ROTATABLE MARINE ELECTRIC CONNECTOR

CROSS REFERENCE TO RELATED APPLICATIONS

U.S. patent application Ser. No. 07/535,047.

BACKGROUND OF THE INVENTION

1. Field of the Invention

This invention relates to marine power connectors required to transmitt power from a shore power receptacle on the dock to which a vessel is moored to the marine power receptacle on the vessel itself. It is important that power be supplied the vessel on an uninterrupted basis to keep the bilge pump powered (a non-powered bilge pump could ultimately result in the loss of the vessel), the refrigerator operational, security systems operational, safety and emergency lights fuctional, etc.

2. Description of the Relevant Art

To date the currently available connectors (which define the present state of the art) are of a straight out, non-rotatable configuration. Now the average height of a marine power receptacle on a vessel is approximately 1 foot above deck level (which helps prevent water on the deck from sloshing into the receptacle, which would short out shipboard power and pose a fire hazard). When a power cord terminating in a currently available marine connector is plugged into the ship marine power receptacle, the connector's straight out design causes the hefty power cord to project horizontally over the deck at a height of one foot. This obstacle creates a potentially serious safety hazard to ship passengers strolling along the deck in that they could trip over the stiff power cord and even fall overboard into the water or onto the dock. There have been several recent cases in Florida alone in which individuals on vessels have tripped over marine power cords and grievously injured themselves.

Inherent in the supply of electricity to vessels via power cords is the ability for the connectors on either end of the power cord to rotate relative to the marine power receptacles on the dock and on the vessel. This requirement exists due to the effects of waves and tide. The former causes the vessel to pitch relative to the power cord, and the latter raises and lowers the elevation of the vessel relative to the dock. Unrelieved, the twisting stresses introduced into the power cord due to these effects will cause power cord, power cord connector, and/or marine power receptacle failure, with the attendant systems failures recited in *Field of the Invention* above and the potential for electrical fire.

The need for electrical connectors with the ability to rotate while maintaining an electrical connection has been recognized in the past and present. This need is especially great in situations where an electrical power cord is moved rotationally in relationship to an electrical connector.

Rotational movements of this type twist, kink and otherwise damage the power cord and the electrical connector which the cord is connected to. Additionally, an electrical connector often presents the power cord at an undesirable angle for practical usage. A common solution to these problems has been to construct an electrical connector which utilizes rotatable electrical contacts which have the additional function of acting as bearings for the rotational movement. The major problem encountered with these designs is the rapid wearing of the electrical contacts as they must bear all of the physical movements the power cord and the electrical connector are subjected to. This wearing of the electrical contacts causes inconsistencies in the electrical contact which creates conditions of ever increasing wear as a result of electrical arcing and eroding of the electrical contacts. Additionally, these designs require a large number of individual parts which increases the cost and complicates the construction, assembly and disassembly of the device.

The present invention eliminates the problems associated with the prior art as it does not rely upon the rotating electrical connections to act as bearings for the rotational movement and it is constructed with a minimum number of parts which simplifies its design and assembly and allows it to be manufactured inexpensively. Further, the present invention allows for the immobilizing of the rotating units in a pre-determined position should it be desired.

SUMMARY OF THE INVENTION

The present invention is an apparatus which allows rotational movement of an electrical power cord in relation to an electrical connection point and should a particular positioning of the power cord be desired, the rotating units can be immobilized to prevent further rotation.

This apparatus, which is attached to an electrical power cord to allow rotational movement of the power cord in relation to a point of electrical connection, includes: a rotatable upper section having a depression defined upon one end and a threaded nut embedded within said depression; extending from within the depression in the upper rotatable section to a desired distance from the other end of the upper rotatable section are electrically conductive skid bars connected to electrical connectors or terminals which are disposed within the depression defined upon the upper rotatable connection; a lower rotatable section which defines an aperture and having a stepped round pyramid defined upon one end; said stepped pyramid defined upon the lower rotatable section is configured to the end of the upper rotatable section from which the skid bars extend; disposed within the stepped pyramid defined upon the lower rotatable section are a plurality of circular electrically conductive skid plates positioned to match the configuration and position of the skid bars; connected to the skid plates and extending from the opposite end of the lower rotatable section as the depression defined upon the lower rotating section are a plurality of electrical contacts which are of any configuration desired for a particular application; disposed within the aperture in the lower rotatable section is a screw which is disposed in an aperture which is defined by a washer; said screw is intended to be threaded into the threaded nut to bring the upper and lower rotatable sections into contact and to bring the skid bars and skid plates into contact, thereby supplying a rotating electrical connection. A tightening of the screw will immobilize the upper and lower sections in a desired position. Also included in the device is a removable boot defining an aperture within which an electrical power cord can be disposed; the removable boot is configured to cover the end of the upper rotatable section which has a depression defined upon it. This boot is supplied to protect the electrical terminals or connectors from adverse weather elements, prevent accidental contact with the electrical terminals and to reduce strain upon the electrical terminals and the power cord.

It is an object of the present invention to provide a rotatable electrical connector of a simple design. It is another object of this invention to provide a rotatable electrical conector which is substantially weather resistant.

An additional object of the present invention is to provide a rotating electrical connector which may be immobilized in a desired position.

A final object of the present invention is to provide a rotatable electrical connector which is constructed of materials which are stable, durable and inexpensive.

BRIEF DESCRIPTION OF THE DRAWINGS

FIG. 3 also shows the electrical contacts 12 in a possible configuration.

DETAILED DESCRIPTION OF THE PREFERRED EMBODIMENT

Figure 1:
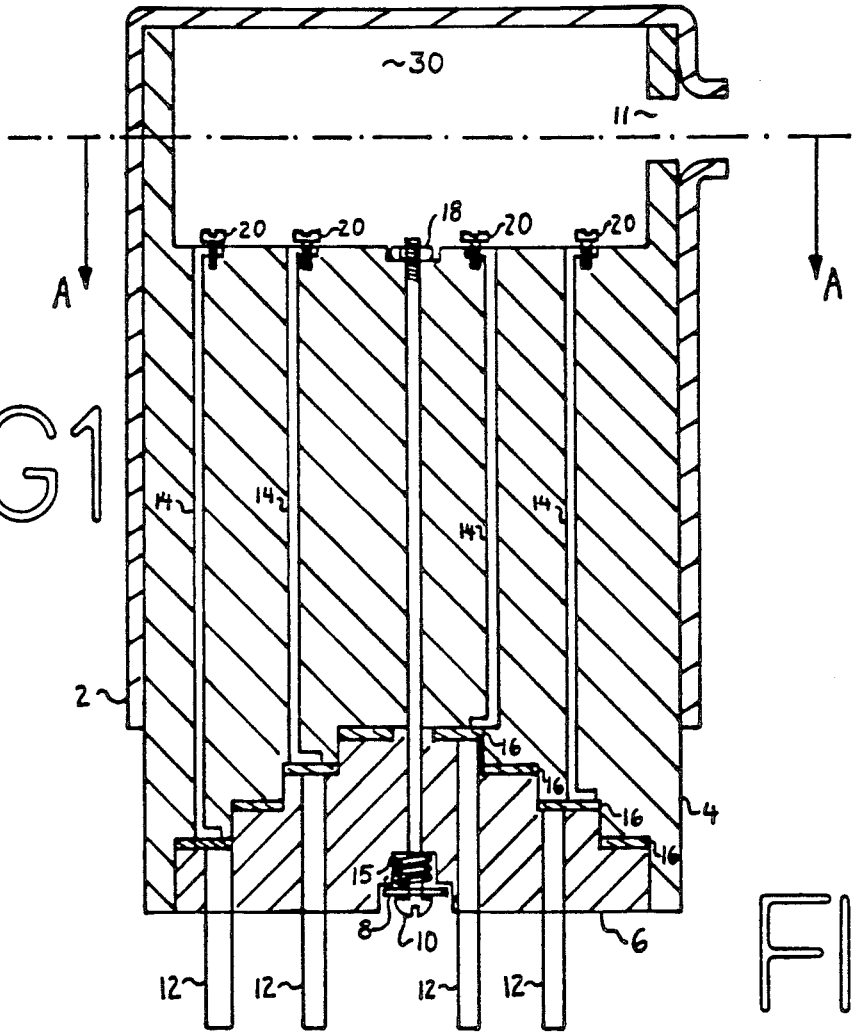
FIG. 1 is a cross-sectional view of the invention.

FIG. 1 shows the invention ready to be attached to a power cord. The power cord would extend through the aperture 11 defined by the removable boot 2 which is configured to fit tightly over the upper rotatable section 4. The power cord would be connected to the electrical terminals or connectors 20 which are common in the art, e.g., such as screws, slip on connectors, wire retainers, etc.. The electrical terminals or connectors 20 are connected to the electrically conductive skid bars 14 which are provided in the number needed for the particular application. The electrical terminals or connectors 20 and the skid bars 14 are disposed within the depression defined upon the upper rotatable section 4 which is substantially cylindrical, and the skid bars 14 are embedded in the material of which the upper rotatable section 4 is constructed. The skid bars 14 extend through the upper rotatable section 4 and project from the side of the upper rotatable section 4 opposite the depression 30 defined upon the upper rotatable section 4. The side of the upper rotatable section 4 from which the skid bars 14 extend has a self-locking nut 18 embedded within it. The skid bars 14 project from the upper rotatable section 4 and make contact with the electrically conductive skid plates 16 which are substantially circular and flat and which are mechanically and electrically connected to electrical contacts 12. The lower rotatable section 6 is configured to adapt the end of the upper rotatable section 4 from which the skid bars 14 project so as to allow rotational movement between the upper rotatable section 4 and the lower rotatable section 6. The screw 10 is threaded through washer 8 and spring 15, and then into self-locking nut 18, thereby bringing the upper rotatable section 4 and the lower rotatable section 6 into contact with one another and also bringing skid bars 14 into contact with the skid plates 16. A complete and forceful threading of the screw 10 into the self-locking nut 18 will bring the upper rotatable section 4 and the lower rotatable section 6 into a contact which will preclude rotational movement between the upper rotatable section 4 and the lower rotatable section 6. Connected to the skid plates 16 are electrical contacts 12 which are of an type and configuration common in the art such as male prongs, female openings, single contact, multiple contact, special usage, etc. shown here in this embodiment as male prongs.

Figure 2:
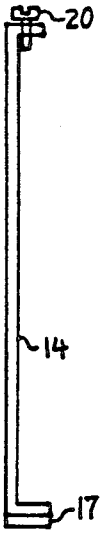
FIG. 2 is a view of skid bar 14 with lower carbon coating 17.

FIG. 2 is a detail view of skid bar 14 with a lower carbon coating 17, and connector 20. The carbon coating 17 conducts electricity while providing a smooth surface to ride on skid plates 16.

Figure 3:
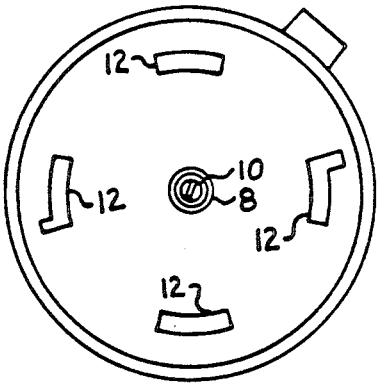
FIG. 3 is an end view of the lower rotatable section 6, the washer 8 and the screw 10.

FIG. 3 shows the electrical contacts 12 in a possible configuration as viewed from the end of the lower rotatable section 6 from which the washer 8 and the screw 10 can be viewed.

Figure 4:
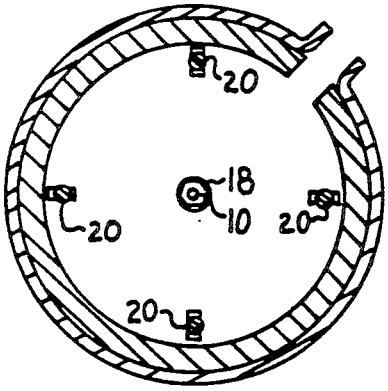
FIG. 4 is a top sectional view of the invention showing provisions for routing the power cord through aperture 11 and connecting same to electrical connectors 20.

FIG. 4 is a top view of the invention at section A—A. Electrical connectors 20 are visible, as well as aperture 11 through which the power cord would be introduced.

The invention is not limited to the embodiment described above and it should be apparent to those skilled in the art that numerous other embodiments can be contemplated which fall within the scope and spirit of the described invention.

I claim:

1. A rotatable electrical connector for maintaining a plurality of electrical circuits between two rotating parts, to be connected to an electrical power cord, comprising, in combination:

(a) an upper section containing an aperture through which a power cord may be introduced at approximately a 90 degree angle to the longitudinal axis of the apparatus;

(b) a lower section operably and rotationally engaged with the upper section;

(c) a boot operably and removeably engaged with the upper section;

(d) a first means for maintaining the upper and lower sections operably and rotatably engaged, said first means comprising:

(i) a threaded nut operably engaged with the upper section;

(ii) a washer;

(iii) a screw operably engaged with the threaded nut and the washer;

(iv) a spring operably engaged with the screw;

(e) a second means for extending at least one electrical circuit between and through the upper and lower sections comprising:

(i) at least one skid bar operably engaged with the upper section, said skid bar having a coating of carbon to facilitate rotation and conduction of electricity;

(ii) at least one electrical terminal operably engaged with the skid bar;

(iii) at least one skid plate operably engaged with the lower section and the skid bar;

(iv) at least one electrical contact operably engaged with one said skid plate.

* * * * *